US010461473B1

(12) United States Patent
Hsiao

(10) Patent No.: US 10,461,473 B1
(45) Date of Patent: Oct. 29, 2019

(54) PULL STRIP CABLE MODULE

(71) Applicant: BizLink International Corp., New Taipei (TW)

(72) Inventor: Hsin-Tuan Hsiao, New Taipei (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 16/290,977

(22) Filed: Mar. 4, 2019

(30) Foreign Application Priority Data

Nov. 20, 2018 (TW) ..... 107215750 U

(51) Int. Cl.
*H01R 13/639* (2006.01)
*H01R 12/72* (2011.01)
*H01R 13/633* (2006.01)

(52) U.S. Cl.
CPC ..... *H01R 13/639* (2013.01); *H01R 12/721* (2013.01); *H01R 13/6335* (2013.01)

(58) Field of Classification Search
CPC . H01R 13/6335; H01R 13/639; H01R 12/721
See application file for complete search history.

(56) References Cited

U.S. PATENT DOCUMENTS 5,564,939 A * 10/1996 Maitani ..... H01R 13/6335 439/352
7,591,664 B2 * 9/2009 Nomiyama ..... H01R 13/6275 439/352
7,857,650 B1 * 12/2010 Wu ..... H01R 13/6275 439/352
8,221,137 B2 * 7/2012 Zheng ..... H01R 13/6581 439/80
8,439,706 B2 * 5/2013 Sytsma ..... H01R 13/65802 439/607.19
8,475,197 B2 * 7/2013 Zerebilov ..... H01R 13/6275 439/352
8,475,199 B2 * 7/2013 Wang ..... H01R 13/6335 439/160
8,550,848 B2 * 10/2013 Wu ..... H01R 13/6583 439/353
8,627,554 B1 * 1/2014 Hagan ..... A44B 11/2569 24/579.11
9,246,262 B2 * 1/2016 Brown ..... H01R 13/62
9,728,871 B1 * 8/2017 Gutgold ..... H01R 12/515
10,038,280 B2 * 7/2018 Schaefer ..... H01R 13/639
10,263,364 B1 * 4/2019 Huang ..... H01R 13/6273
2012/0329305 A1 * 12/2012 Ritter ..... H01R 13/6275 439/350
2014/0134898 A1 * 5/2014 Wang ..... H01R 13/6275 439/843

(Continued)

*Primary Examiner* — Briggitte R. Hammond
(74) *Attorney, Agent, or Firm* — CKC & Partners Co., LLC

(57) ABSTRACT

A pull strip cable module includes a connector, a U-shaped spring latch and a pull strip. The U-shaped spring latch includes a U-shaped elastic portion, a first end portion extending outwardly from one end of the U-shaped elastic portion and a second end portion extending outwardly from another end of the U-shaped elastic portion. In addition, a sliding opening is formed on the first end portion. The U-shaped spring latch is fixed on the connector, and one end of the pull strip is fixed to the second end portion of the U-shaped spring latch and the pull strip passes through the sliding opening of the first end portion of the U-shaped spring latch.

10 Claims, 3 Drawing Sheets

(56) References Cited

U.S. PATENT DOCUMENTS

2014/0193993 A1* 7/2014 Meng ..... H01R 13/633
439/352
2014/0349509 A1* 11/2014 Zhu ..... H01R 13/6275
439/350

* cited by examiner

PULL STRIP CABLE MODULE

RELATED APPLICATIONS

This application claims priority to Taiwan Application Serial Number 107215750, filed Nov. 20, 2018, which is herein incorporated by reference.

TECHNICAL FIELD

The present disclosure generally relates to a pull strip cable module. More particularly, the present disclosure relates to a soft pull strip cable module.

BACKGROUND

With the development and innovation of various high frequency electronic products, new high frequency electronic products require relatively more bandwidth. Therefore, the world today relies on the rapid and reliable information transmission.

In addition, the rapid development of the information industry is very demanding on the performance of the server, and the first priority for maintaining the performance of the server is to maintain the operating temperature of the central processing unit thereof so that the heat dissipation solution thereof becomes very important. In order to achieve a better heat dissipation, most of the connectors of the server are placed in a non-intermediate position, such as the edge of the casing of the server rather than the center position thereof, to increase the space for allowing the airflow to flow smoothly, thereby effectively improving the heat dissipation performance of the central processing and the circuits thereof.

A conventional cable connector normally requires a resilient latch to engage a corresponding connector of an electronic device to prevent the cable connector from being easily detached from the electronic device. Therefore, when a user is willing to separate the cable connector from the corresponding connector of the electronic device, the user has to press the resilient latch with his finger. However, when the corresponding connector of the electronic device is too close to the edge of the electronic device, the user is difficult to press the resilient latch with his finger, so that the cable connector is not easily separated from the electronic device connector.

SUMMARY

One objective of the embodiments of the present invention is to provide a pull strip cable module to conveniently release a cable connector from an electronic device.

To achieve these and other advantages and in accordance with the objective of the embodiments of the present invention, as the embodiment broadly describes herein, the embodiments of the present invention provides a pull strip cable module including a connector, a U-shaped spring latch and a pull strip. The U-shaped spring latch includes a U-shaped elastic portion, a first end portion outwardly extending from one end of the U-shaped elastic portion and including a sliding opening, and a second end portion outwardly extending from another end of the U-shaped elastic portion.

The U-shaped spring latch is fixed on the connector and one end of the pull strip is fixed to the second end portion of the U-shaped spring latch, and the pull strip passes through the sliding opening of the first end portion of the U-shaped spring latch.

In some embodiments, the second end portion includes a locking protrusion to engage a locking opening of an electronic device connector.

In some embodiments, the second end portion includes a pressing protrusion configured to press the second end portion to detach the locking protrusion from the locking opening of the electronic device connector.

In some embodiments, the second end portion includes a pull strip fixing hole located at a terminal of the second end portion to fix the pull strip. In addition, the first end portion includes a pull strip sliding support located above the sliding opening.

In some embodiments, the pull strip fixing hole is located above the sliding opening.

In some embodiments, the first end portion includes a fixing hole and the connector includes a fixing protrusion to engage the fixing hole.

In some embodiments, the connector includes a pair of sliding trenches to slidably engage two sides of the first end portion.

In some embodiments, the connector includes a plurality of connecting terminals and a cable electrically connected to the connecting terminals. In addition, the connecting terminals are golden fingers on a circuit board, the connector further includes a connecting main body overmolding the circuit board and exposing the golden fingers, the cable is welded on the circuit board, and the U-shaped spring latch is fixed on the connecting main body.

Hence, the pull strip cable module can be easily withdrawn from the electronic device connector as well as conveniently coupled to the electronic device connector close to the edge of the electronic device. The user only needs to pull the pull strip for releasing the pull strip cable module so that the pull strip cable module can conveniently be removed from the electronic device connector.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
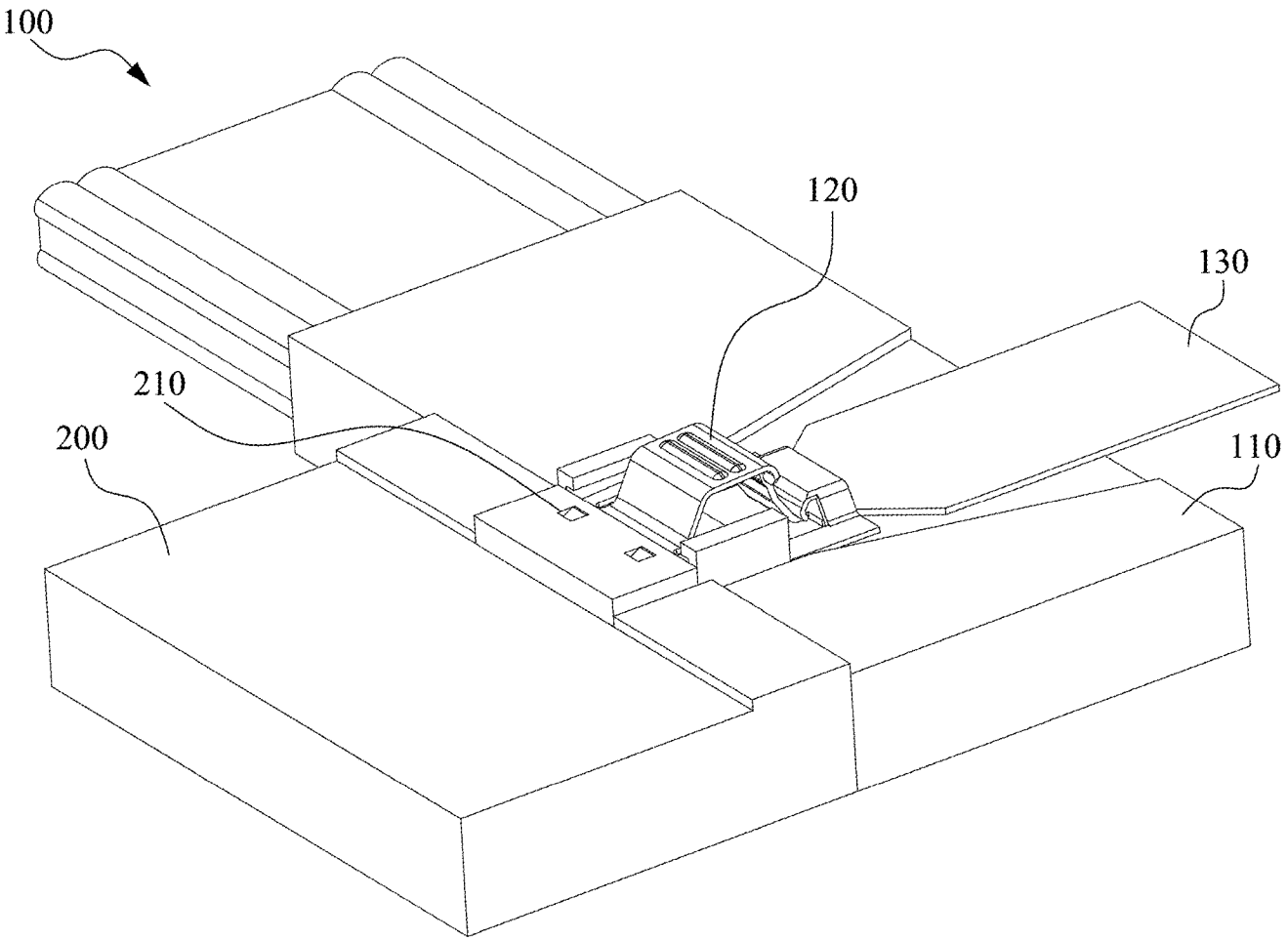
FIG. 1 illustrates a perspective view of a pull strip cable module according to one embodiment of the present invention coupled to an electronic device connector.
Figure 2:
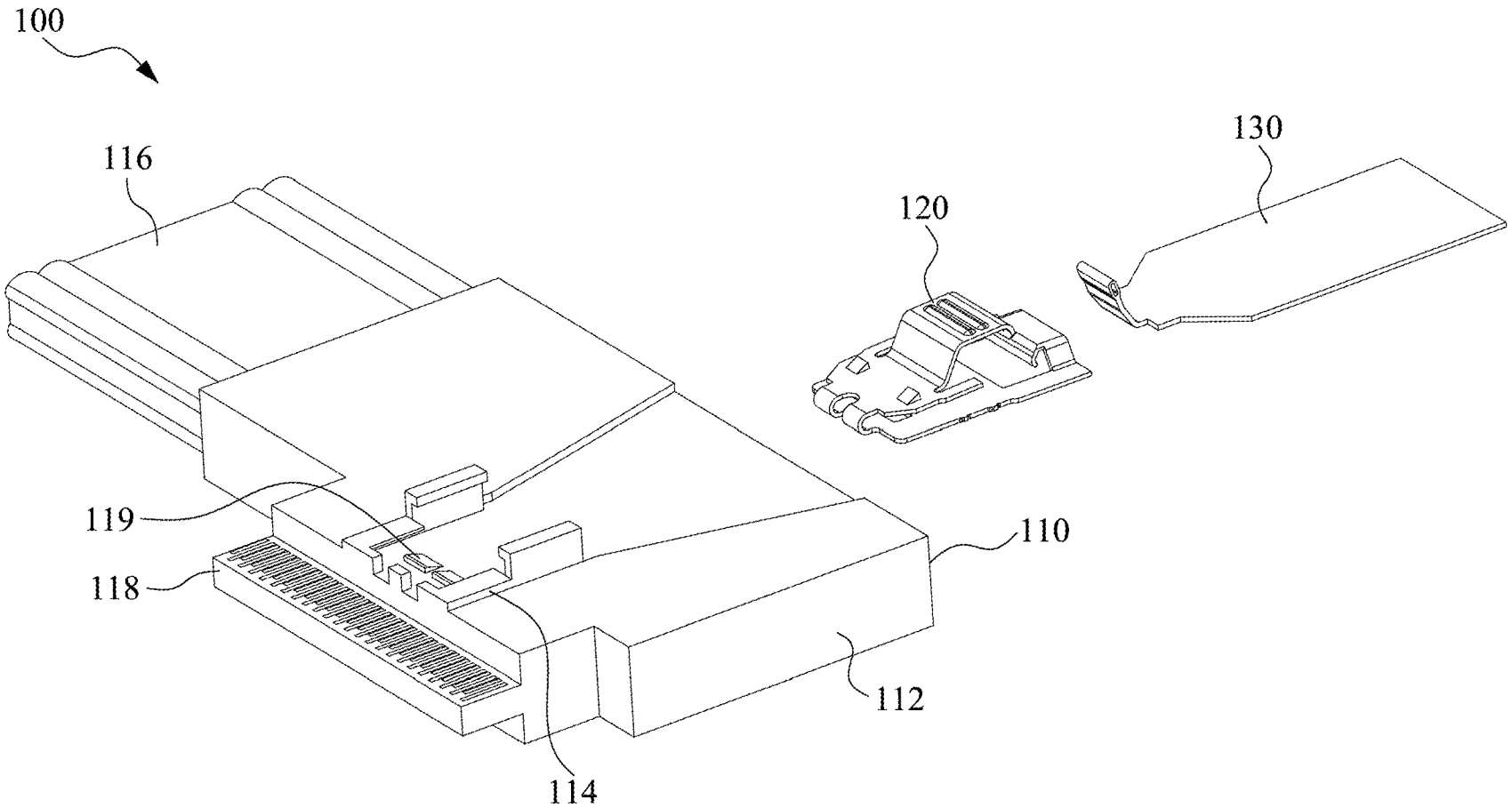
FIG. 2 illustrates an exposed perspective view of a pull strip cable module according to one embodiment of the present invention.
Figure 3:
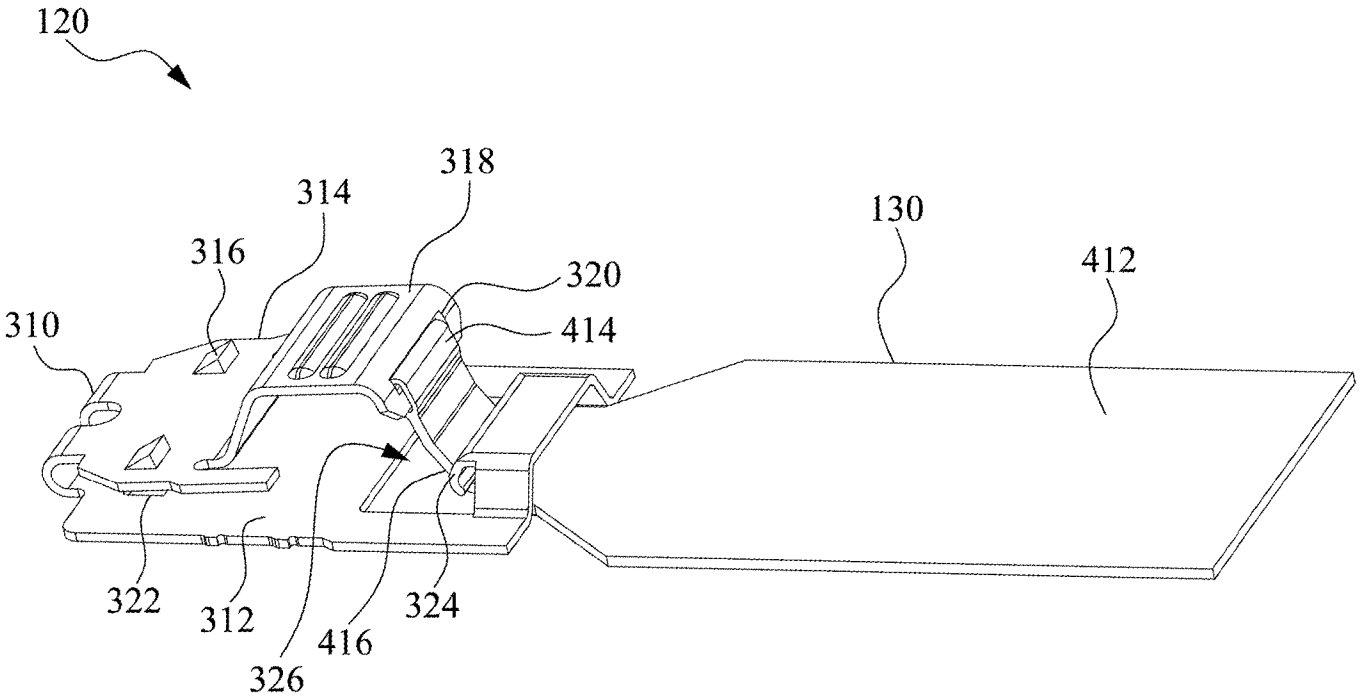
FIG. 3 illustrates a perspective view of a U-shaped spring latch and a pull strip of a pull strip cable module according to one embodiment of the present invention.

FIG. 1 illustrates a perspective view of a pull strip cable module according to one embodiment of the present invention coupled to an electronic device connector, FIG. 2 illustrates an exposed perspective view of the pull strip cable module, and FIG. 3 illustrates a perspective view of a U-shaped spring latch and a pull strip thereof.

Referring to FIG. 1, the pull strip cable module 100 is inserted into an electronic device connector 200. When a user wants to detach the pull strip cable module 100 from the electronic device connector 200, the user has to pull the pull strip 130 outward to release the U-shaped spring latch 120 from the locking opening 210 of the electronic device connector 200 and the pull strip cable module 100 can further be pulled out from the electronic device connector 200. Since the direction for pulling the pull strip 130 and the direction for detaching the pull strip cable module 100 from the electronic device connector 200 are toward a same direction, the user can simultaneously pull the pull strip 130 and the pull strip cable module 100 from the electronic device connector 200 outwardly. Therefore, the pull strip cable module 100 can be easily and quickly detached from the electronic device connector 200.

As shown in FIGS. 2 and 3, the pull strip cable module 100 includes a connector 110, a U-shaped spring latch 120 and a pull strip 130. The U-shaped spring latch 120 includes a U-shaped elastic portion 310, a first end portion 312 and a second end portion 314. The first end portion 312 extends outwardly from one end of the U-shaped elastic portion 310 and the second end portion 314 extends outwardly from another end of the U-shaped elastic portion 310, and the U-shaped elastic portion 310 connects to the first end portion 312 and the second end portion 314. In addition, a sliding opening 326 are formed on the first end portion 312.

The U-shaped spring latch 120 is fixed on the connector 110, one end of the pull strip 130 is fixed to the second end portion 314 of the U-shaped spring latch 120, and the pull strip 130 is passed through a sliding opening 326 of the first end portion 312 of the U-shaped spring latch 120. As shown in the drawings, the pull strip 130 is fixed at the second end portion 314 of the U-shaped spring latch 120 and above the sliding opening 326. Therefore, the pull strip 130 can force the second end portion 314 of the U-shaped spring latch 120 to approach the first end portion 312 of the U-shaped spring latch 120 so that locking protrusions 316 on the second end portion 314 can be released from the locking openings 210. The locking protrusion 316 is configured to engage the locking opening 210 of the electronic device connector 200 to prevent the pull strip cable module 100 from unpredictably escaping from the electronic device connector 200 to maintain the safety and reliability of signal transmission.

In some embodiments, the second end portion 314 includes a pressing protrusion 318 configured to press the second end portion 314 to release the locking protrusion 316 from the locking opening 210 of the electronic device connector 200.

In some embodiments, the second end portion 314 further includes a pull strip fixing hole 320 located at a terminal of the second end portion 314 to fix to the pull strip 130. In addition, the first end portion 312 includes a pull strip sliding support 324 located above the sliding opening 326. In some embodiments, the pull strip fixing hole 320 is nearly located above the sliding opening 326. In addition, the pull strip sliding support 324 is slightly higher than the surface of the connector 110 to allow the pull strip 130 passing through and moving in the sliding opening 326.

In some embodiments, the pull strip 130 includes a fixing end 414, a sliding portion 416 and a pulling end 412. The fixing end 414 is fixed to the pull strip fixing hole 320 of the second end portion 314, and the sliding portion 416 is extended from the fixing end 414 outwardly and passed through the sliding opening 326 of the first end portion 312. While pulling the pull strip 130, the pull strip sliding support 324 is a supporting point for the sliding portion 416 to change the moving direction of the pull strip 130 so that the fixing end 414 can move downwardly and the sliding portion 416 can move downwardly and further change to move outwardly. In addition, the pulling end 412 is extended from the sliding portion 416 outwardly and exposed outside the U-shaped spring latch 120 and the sliding opening 326 so that the user can conveniently pull the pull strip 130.

In some embodiments, the first end portion 312 of the U-shaped spring latch 120 further includes a fixing hole 322 and the connector 110 includes a fixing protrusion 119 to engage the fixing hole 322 so as to fix the U-shaped spring latch 120 on the connector 110.

In some embodiments, the connector 110 includes a pair of sliding trenches 114 to slidably couple to two sides of the first end portion 312.

In some embodiments, the connector 110 includes a plurality of connecting terminals 118 and a cable 116 electrically connected to the connecting terminals 118.

In some embodiments, the connecting terminals are golden fingers on a circuit board, and the connector 110 further includes a connecting main body 112 overmolding the circuit board by a plastic material and exposing the golden fingers. In addition, the cable 116 is welded on the circuit board and the U-shaped spring latch 120 is fixed on the connecting main body 112.

Accordingly, the pull strip cable module can be easily withdrawn from the electronic device connector and conveniently coupled to the electronic device connector close to the edge of the electronic device. The user only needs to pull the pull strip for releasing the pull strip cable module, and therefore the pull strip cable module can conveniently be removed from the electronic device connector.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A pull strip cable module, comprising:

a connector;

a U-shaped spring latch fixed on the connector, wherein the U-shaped spring latch comprises:

a U-shaped elastic portion;

a first end portion outwardly extending from one end of the U-shaped elastic portion, wherein the first end portion comprises a sliding opening; and a second end portion outwardly extending from another end of the U-shaped elastic portion; and a pull strip, wherein one end of the pull strip is fixed to the second end portion of the U-shaped spring latch, and the pull strip passes through the sliding opening of the first end portion of the U-shaped spring latch.

2. The pull strip cable module of claim 1, wherein the second end portion comprises a locking protrusion to engage a locking opening of an electronic device connector.

3. The pull strip cable module of claim 2, wherein the second end portion comprises a pressing protrusion configured to press the second end portion to detach the locking protrusion from the locking opening of the electronic device connector.

4. The pull strip cable module of claim 1, wherein the second end portion comprises a pull strip fixing hole located at a terminal of the second end portion to fix the pull strip.

5. The pull strip cable module of claim 4, wherein the first end portion comprises a pull strip sliding support located above the sliding opening.

6. The pull strip cable module of claim 5, wherein the pull strip fixing hole is located above the sliding opening.

7. The pull strip cable module of claim 1, wherein the first end portion comprises a fixing hole and the connector comprises a fixing protrusion to engage the fixing hole.

8. The pull strip cable module of claim 1, wherein the connector comprises a pair of sliding trenches to slidably engage two sides of the first end portion.

9. The pull strip cable module of claim 8, wherein the connector comprises a plurality of connecting terminals and a cable electrically connected to the connecting terminals.

10. The pull strip cable module of claim 9, wherein the connecting terminals are golden fingers on a circuit board, the connector further comprises a connecting main body overmolding the circuit board to expose the golden fingers, the cable is welded on the circuit board, and the U-shaped spring latch is fixed on the connecting main body.

* * * * *